United States Patent [19]

Kerpers et al.

[11] Patent Number: 4,620,392

[45] Date of Patent: Nov. 4, 1986

[54] DOOR BEARING AND DOOR ASSEMBLY

[75] Inventors: Werner Kerpers, Bingen; Thomas Durstewitz, Fritzlar, both of Fed. Rep. of Germany

[73] Assignee: Licentia Patent-Verwaltungs-GmbH, Frankfurt am Main, Fed. Rep. of Germany

[21] Appl. No.: 604,483

[22] Filed: Apr. 27, 1984

[30] Foreign Application Priority Data

Apr. 28, 1983 [DE] Fed. Rep. of Germany ..... 3315346

[51] Int. Cl.[4] ..... E05D 7/02

[52] U.S. Cl. ..... 49/382; 16/229; 49/388

[58] Field of Search ..... 49/193, 382, 388; 403/320; 16/229, 230, 255–259

[56] References Cited

U.S. PATENT DOCUMENTS

| | | | |
|---|---|---|---|
| 84,868 | 12/1868 | Fenn | 403/320 X |
| 1,714,575 | 5/1929 | Stancliff | 49/382 X |
| 1,767,487 | 6/1930 | Shogren | 49/388 |
| 2,086,529 | 7/1937 | Bontemps | 49/388 X |
| 2,206,755 | 7/1940 | Schweller . | |
| 2,603,825 | 7/1952 | Seaman | 49/388 X |
| 3,378,954 | 4/1968 | Sandin | 49/193 X |
| 3,396,490 | 8/1968 | Dukas | 49/382 |
| 3,778,932 | 12/1973 | Ewing | 49/388 |
| 3,863,391 | 2/1975 | Horvay et al. | 49/382 |
| 4,377,055 | 3/1983 | Frederick | 49/388 |

FOREIGN PATENT DOCUMENTS

| | | | |
|---|---|---|---|
| 761291 | 6/1971 | Belgium . | |
| 990585 | 6/1976 | Canada | 49/388 |
| 1869023 | 3/1963 | Fed. Rep. of Germany . | |
| 1197480 | 7/1965 | Fed. Rep. of Germany . | |
| 7612231 | 4/1976 | Fed. Rep. of Germany . | |
| 2609848 | 10/1976 | Fed. Rep. of Germany | 49/383 |
| 48250 | 4/1977 | Japan | 49/382 |
| 585840 | 9/1977 | Switzerland . | |
| 972813 | 10/1964 | United Kingdom . | |

*Primary Examiner*—William E. Lyddane
*Assistant Examiner*—James R. Brittain
*Attorney, Agent, or Firm*—Spencer & Frank

[57] ABSTRACT

In a door bearing, a bearing arm having a bearing bore is fastened to a stationary construction, such as a door frame. A bearing pin which is axially displaceable in the door engages the bearing bore. In order to permit quick and simple release of the bearing in a minimum amount of space, an open recess is provided within the door. Through this open recess, the bearing pin can be reached manually or by means of a tool in order to withdraw it from the bearing bore.

6 Claims, 5 Drawing Figures

DOOR BEARING AND DOOR ASSEMBLY

BACKGROUND OF THE INVENTION

The present invention relates to a door bearing, and more particularly to a bearing which employs an axially displaceable bearing pin that is disposed within a door.

In German Utility Model No. 7,612,231, a bearing groove is provided at the inside of the door. A bearing arm provided with a bearing bore is fastened to the cabinet and extends into the bearing groove in the door. A bearing pin inserted from the top of the door passes through the bearing bore. Thus, for installing or removing the door enough free space must be at the top of the door to ensure that the bearing arm is free upon removal of the bearing pin. However, this space may not be available, particularly if the door is tightly integrated into a furniture front. In such cases it is necessary to first remove the furniture front, which must then be reattached and aligned again.

SUMMARY OF THE INVENTION

It is the object of the present invention to provide a door bearing and door assembly which uses an axially displaceable bearing pin but which permits quick and simple installation or removal of the door.

This is accomplished according to the present invention by providing an open recess in the door which extends to the bearing passage for accommodating the pin, the dimensions of the recess in the direction parallel to the bearing pin equalling or exceeding the distance by which the bearing pin must be withdrawn to free the pin from the bearing bore in the bearing arm which is mounted on a stationary component adjacent the door, such as a frame for the door. In this way, the free space required for the axial release of the bearing pin from the bearing bore is disposed within the door itself and is open for free access from outside. Through this opening, the bearing pin can be displaced manually or by means of a tool. A spring may be used to bias the bearing pin toward the bearing bore. To release the bearing connection, the bearing pin need merely be displaced against the force of the spring. For this purpose, a handle may be provided in the region of the opening in the recess, which handle can be gripped directly by hand or by means of a tool.

DESCRIPTION OF THE PREFERRED EMBODIMENTS

Figure 1:
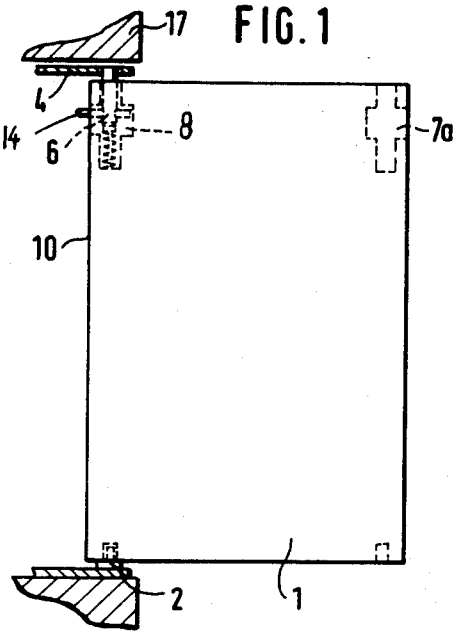
FIG. 1 is a front elevational view of a preferred embodiment of the invention.
Figure 2:
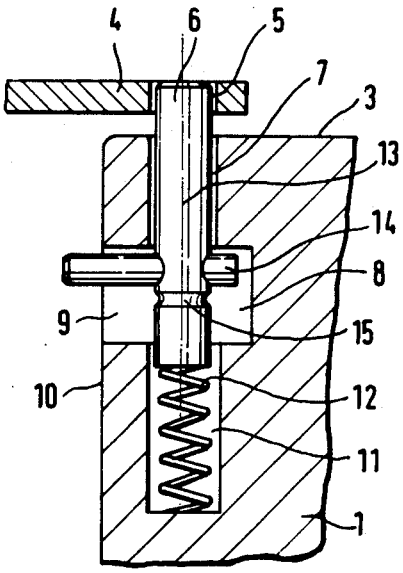
FIG. 2 is an enlarged partial sectional view taken along a plane parallel to the drawing plane of FIG. 1.

With reference to FIGS. 1 and 2, a door 1 for a refrigerator or freezer is pivotally mounted at the bottom by a pin bearing 2. At the top of the door, along the axis of bearing 2, there is a further door bearing which is provided with a bearing arm 4 fastened to a housing (not shown in detail). Bearing arm 4 is provided with a bearing bore 5 to accommodate bearing pin 6. Bearing pin 6 is axially displaceable within a bearing passage 7 provided in door 1. Bearing passage 7 opens into a recess 8 likewise provided in the door, and an opening or port 9 provides access from outside. The opening or port 9 extends transversely to the axis 13 of the passage 7 and the bearing pin 6. Opening 9 is provided in the vertical narrow side wall 10 (that is, the edge) of door 1; however, it may also be disposed in the large inner or outer side wall (that is, the front or back wall) of door 1. A blind bore 11 that is coaxial with bearing passage 7 opens into recess 8. A spring 12 seated in bore 11 urges bearing pin 6 toward bearing arm 4 and, in operation, keeps the end of pin 6 in bearing bore 5. Recess 8 and blind bore 11 are here dimensioned in such a manner that bearing pin 6 can be axially displaced toward the interior of door 1 to the extent that the end of pin 6 can be withdrawn from bearing bore 5.

Figure 5:
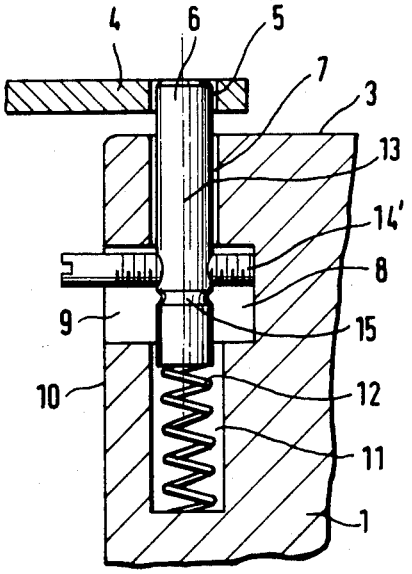
FIG. 5 is an enlarged partial sectional view corresponding to FIG. 2 and illustrating a modification thereof.

With continuing reference to FIG. 2, a removably fixed pin 14 extending transversely to the longitudinal axis 13 of bearing pin 6 serves as a handle for displacing pin 6. The end of pin 14 projects from opening 9 so that bearing pin 6 can be axially displaced manually or by engagement with a tool. Alternately, spring 12 can be omitted, if desired and pin 14 can be replaced by a screw which passes transversely through the bearing pin 6 and is adapted to clamp against the bottom of the recess 8 in order to prevent bearing pin 6 from shifting axially. FIG. 5, for example, illustrates a threaded pin 14' extending through bearing pin 6. Releasing of the door bearing is then possible only by intentional action. Furthermore, in addition to or instead of pin 14, a circumferential groove 15 may be provided in bearing pin 6 in the region of recess 8. If required, a screw driver or the like can engage in the groove 15 and effect the axial displacement. To facilitate use of groove 15, it is advisable to position opening 9 at the back surface of door 1. This also applies if pin 14 does not project through opening 9.

According to FIGS. 1 and 2, bearing arm 4 is disposed outside the periphery of door 1. In the illustrated operating position, bearing pin 6 therefore projects through the narrow top side 3 of door 1.

Figure 3:
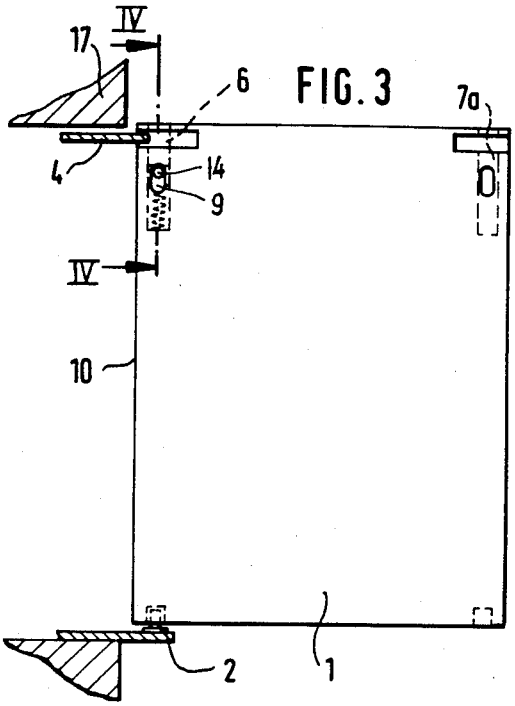
FIG. 3 is a front elevational view of another preferred embodiment of the invention.
Figure 4:
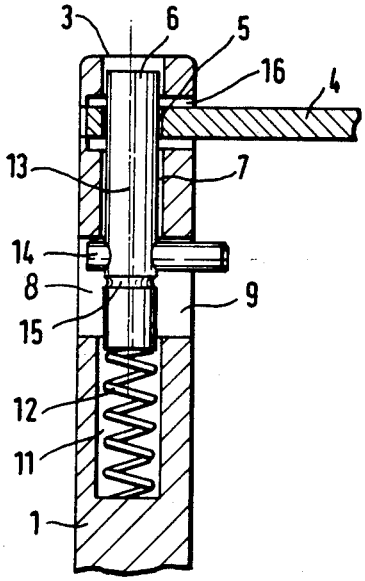
FIG. 4 is an enlarged partial sectional view taken along line IV—IV of FIG. 3.

According to the embodiment shown in FIGS. 3 and 4, the bearing pin 6 is arranged in a hidden manner within the periphery of the door. For this purpose, a bearing recess 16 is provided within the peripheral outline of the door. When the door is installed bearing arm 4 extends into recess 16, where it is engaged by bearing pin 6. The recess 8 and the pin (handle) 14 are spaced from the recess 16 in the direction away from the arm 4. FIG. 3 also shown an external boundary 17 which may be formed by front furniture walls or doors disposed adjacent door 1. The outer end of pin 14 may extend into a narrow gap so that pin 14 is then externally accessible.

In order to install or remove door 1, it is then merely necessary to axially displace bearing pin 6 by means of handle 14 or groove 15 toward the middle of the door so that support at the upper region of the door is removed. Additional free space toward the top is no longer required because bearing pin 6 is retracted only into the boundaries of the door or, according to FIGS. 3 and 4, is not moved outside the periphery of the door. Thus, during removal, the door can be tilted away from the upper side of the housing of the device (not shown) and may then be lifted out with the lower pin bearing 2 in an oblique position. If pin 14 is releasably fixed in bearing pin 6, e.g. is screwed thereinto, removal of pin 14 enables bearing pin 6 to be pulled out of its bearing passage and to be placed into a corresponding bearing passage *7a* equipped with recesses on the opposite side of the door, where it can be held with the same pin 14. Thus, no separate bearing pin 6 is required for right-hand or left-hand operation of door 1.

It will be understood that the above description of the present invention is susceptible to various modifications, changes and adaptations, and the same are intended to be comprehended within the meaning and range of equivalents of the appended claims.

What is claimed is:

1. In a door bearing and door assembly for pivotally mounting the door on a supporting structure of a household refrigeration appliance; said door bearing including a bearing arm for securement to said supporting structure; said bearing arm having a bearing bore; an elongated bearing pin; said door including an elongated passage slidably receiving said elongated bearing pin; said elongated bearing pin having an operative position in which said bearing pin extends into said bearing bore; the improvement wherein said door has a recess adjoining said elongated passage in a length dimension thereof, said recess having an end wall; said recess having a dimension parallel to said length dimension; said dimension of said recess being sufficiently large to accommodate portions of said bearing pin in a withdrawn position thereof in which said bearing pin is clear of said bearing bore; an outwardly open port in said door communicating with said recess and extending transversely to said length dimension; said open port providing access to said bearing pin for displacing said bearing pin into said withdrawn position; wherein spring means is provided for urging said bearing pin into said operative position; and wherein engageable means is provided on said bearing pin in the zone of said recess for permitting manual displacement of said bearing pin between said operative and withdrawn positions by access through said port, said engageable means including a screw which extends transversely through said bearing pin, which provides a handle projecting from said port, and which has an end that is adapted to press against said end wall of said recess to immobilize said bearing pin.

2. An assembly as defined in claim 1, further comprising an additional, outwardly open recess communicating with said elongated passage; said bearing arm extending into said additional recess and said bearing bore being in alignment with said elongated passage.

3. An assembly as defined in claim 1, wherein said passage terminates in a blind bore and said recess is situated between said bearing bore and said blind bore; and further wherein said spring means comprises a compression spring accommodated in said blind bore and engaging said bearing pin.

4. An assembly as defined in claim 1, wherein said engageable means further includes a groove provided in said bearing pin.

5. An assembly as defined in claim 4, wherein said groove extends circumferentially about said bearing pin.

6. An assembly as defined in claim 1, wherein said door has first and second sides, with said elongated passage, recess, and port being provided at said first side of said door; wherein said door has a further elongated passage, recess, and port at the second side thereof; and wherein said screw is releasably secured to said bearing pin so that said bearing pin, spring means, and screw can be transferred from said elongated passage, recess, and port to said further elongated passage, recess, and port to permit said door to be pivotally mounted at said second side rather than said first side.

* * * * *